US008791884B2

(12) United States Patent
Kim

(10) Patent No.: US 8,791,884 B2
(45) Date of Patent: Jul. 29, 2014

(54) ORGANIC LIGHT EMITTING DISPLAY AND METHOD OF DRIVING THE SAME

(75) Inventor: Do-Ik Kim, Suwon-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 683 days.

(21) Appl. No.: 12/314,137

(22) Filed: Dec. 4, 2008

(65) Prior Publication Data

US 2009/0147032 A1 Jun. 11, 2009

(30) Foreign Application Priority Data

Dec. 5, 2007 (KR) ..... 10-2007-0125545

(51) Int. Cl.
*G09G 3/30* (2006.01)
*G09G 5/10* (2006.01)

(52) U.S. Cl.
USPC ..... 345/77; 345/76; 345/204; 345/690; 345/46; 345/205; 345/207; 345/169; 345/36; 315/169.3

(58) Field of Classification Search
USPC ..... 345/690, 76, 204
See application file for complete search history.

(56) References Cited

U.S. PATENT DOCUMENTS

| | | | | |
|---|---|---|---|---|
| 6,552,735 | B1 * | 4/2003 | Dehmlow | 345/690 |
| 6,788,003 | B2 | 9/2004 | Inukai et al. | |
| 7,006,026 | B2 * | 2/2006 | Jo | 341/144 |
| 7,158,157 | B2 | 1/2007 | Yamazaki et al. | |
| 7,199,771 | B2 | 4/2007 | Yamazaki et al. | |
| 2003/0063053 | A1 * | 4/2003 | Yamazaki et al. | 345/82 |
| 2003/0071804 | A1 * | 4/2003 | Yamazaki et al. | 345/204 |
| 2005/0030214 | A1 | 2/2005 | Jo | |
| 2005/0083268 | A1 | 4/2005 | Mori et al. | |
| 2005/0088379 | A1 | 4/2005 | Tsuchida | |
| 2006/0103684 | A1 * | 5/2006 | Yamazaki et al. | 345/690 |
| 2006/0164408 | A1 | 7/2006 | Nishikawa et al. | |
| 2010/0060620 | A1 | 3/2010 | Yamazaki et al. | |

FOREIGN PATENT DOCUMENTS

| | | |
|---|---|---|
| CN | 1306312 A | 8/2001 |
| CN | 1 737 891 A | 2/2006 |
| EP | 1117085 A2 | 7/2001 |

(Continued)

OTHER PUBLICATIONS

Japanese Office Action in JP 2008-014132, dated Mar. 15, 2011 (Kim).

(Continued)

*Primary Examiner* — Grant Sitta
(74) *Attorney, Agent, or Firm* — Lee & Morse, P.C.

(57) ABSTRACT

There is provided a method of driving an organic light emitting display capable of displaying an image with uniform brightness. The method includes storing a brightness characteristic corresponding to emission time of an organic light emitting diode (OLED), adding first data supplied in units of frames by pixels to generate accumulated data, extracting accumulated data of a pixel to which currently supplied first data is to be supplied and calculating maximum brightness corresponding to emission time of the extracted accumulated data, calculating maximum brightness corresponding to emission time of largest accumulated data among the accumulated data, controlling a bit value of the first data using maximum brightness of a pixel to which the first data is to be supplied and maximum brightness of the largest accumulated data to generate second data, and controlling a voltage value of a first power source supplied to the pixels in response to the maximum brightness of the largest accumulated data.

19 Claims, 8 Drawing Sheets

(56) References Cited

FOREIGN PATENT DOCUMENTS

| | | | | |
|---|---|---|---|---|
| EP | 1 617 400 | A | | 1/2006 |
| EP | 1617400 | A2 | * | 1/2006 |
| JP | 2000-356981 | A | | 12/2000 |
| JP | 2001-195026 | A | | 7/2001 |
| JP | 2003-173164 | A | | 6/2003 |
| JP | 2003-255901 | A | | 9/2003 |
| JP | 2003-330421 | A | | 11/2003 |
| JP | 2004-145257 | A | | 5/2004 |
| JP | 2006-030318 | A | | 2/2006 |
| JP | 2006-343763 | A | | 12/2006 |
| JP | 2007-286295 | A | | 11/2007 |
| KR | 10-2002-0063524 | A | | 8/2002 |
| KR | 10-2003-0027788 | A | | 4/2003 |
| KR | 10-2003-0027846 | A | | 4/2003 |
| KR | 10-2005-0005773 | A | | 1/2005 |
| KR | 10-2007-0062836 | A | | 6/2007 |
| TW | 546596 | | | 8/2003 |
| TW | I272775 | | | 2/2007 |
| TW | I285361 | | | 8/2007 |
| WO | WO 03/038798 | A2 | | 5/2003 |
| WO | WO 2005/114637 | A2 | | 12/2005 |
| WO | WO 2007/079572 | A1 | | 7/2007 |

OTHER PUBLICATIONS

Certificate of Invention Patent in CN 101452668 B, dated Mar. 23, 2011, with English Translation.

European Search Report in EP 08253900.8-2205/2068299, dated May 17, 2011 (Kim).

Japanese Office Action in JP 2008-014132, dated Jan. 31, 2012 (Kim).

Taiwanese Office Action Dated Jan. 30, 2013.

* cited by examiner

ORGANIC LIGHT EMITTING DISPLAY AND METHOD OF DRIVING THE SAME

BACKGROUND

1. Technical Field

Embodiments relate to an organic light emitting display and a method of driving the same. More particularly, embodiments relate to an organic light emitting display capable of displaying an image with uniform brightness and a method of driving the same.

2. Description of the Related Art

Various flat panel displays (FPDs) having relatively lower weight and lower volume than cathode ray tube (CRT) displays have been developed. FPDs include liquid crystal displays (LCD), field emission displays (FED), plasma display panels (PDP) and organic light emitting displays.

Among the FPDs, the organic light emitting displays display images using organic light emitting diodes (OLED) that generate light by the re-combination of electrons and holes. Organic light emitting displays generally have relatively high response speed and may be driven with relatively low power.

In general, OLEDs deteriorate as a result of time, e.g., age and/or emission time and/or temperature, etc. As a result of such deterioration, brightness uniformity of an image may be reduced. Further, brightness uniformity among pixels may be affected by differences in threshold voltages of driving transistors employed for driving respective OLEDs. Digital driving methods may be advantageous for providing brightness uniformity by displaying an image regardless of differences in threshold voltage of driving transistors. However, in the digital driving method, because a constant voltage is applied to the OLEDs, the OLEDs deteriorate faster and brightness uniformity of an image may be compromised.

Pixel circuits and displays and methods of driving thereof for providing improved brightness uniformity are desired.

SUMMARY

Embodiments are therefore directed to flat panel displays, e.g., organic light emitting displays, and methods of driving flat panel displays that substantially overcome one or more of the problems due to the limitations and disadvantages of the related art.

It is therefore a feature of an embodiment to provide a flat panel display adapted to display an image with uniform and/or substantially uniform brightness.

It is therefore a separate feature of an embodiment to provide a method of driving a flat panel display that is adapted to display an image with uniform and/or substantially uniform brightness.

It is therefore a separate feature of an embodiment to provide an organic light emitting display adapted to display an image with uniform and/or substantially uniform brightness.

It is therefore a separate feature of an embodiment to provide a method of driving an organic light emitting display adapted to display an image with uniform and/or substantially uniform brightness.

It is therefore a separate feature of an embodiment to provide a flat panel display, e.g., an organic light emitting display, having improved brightness uniformity as compared to known devices.

It is therefore a separate feature of an embodiment to provide a method of driving a flat panel display, e.g., an organic light emitting display, having improved brightness uniformity as compared to known devices.

At least one or more of the above and other features and advantages of embodiments may be realized by providing a method of driving an organic light emitting display, including storing a brightness characteristic corresponding to emission time of an organic light emitting diode (OLED), generating accumulated data by adding together first data supplied in units of frames to each of a plurality of pixels, the accumulated data for each of the pixels corresponding to an emission time of the respective one of the plurality of pixels, determining a maximum brightness of a selected one of the pixels to which current first data is to be supplied based on the accumulated data corresponding to the selected pixel and the stored brightness characteristic, determining a maximum brightness corresponding to an emission time of a largest of the accumulated data among the accumulated data for each of the pixels, and generating second data by controlling a bit value of the current first data using the maximum brightness of the selected one of pixels to which the current first data is to be supplied and the maximum brightness of the largest accumulated data.

The method may include controlling a voltage value of a first power source supplied to the pixels in response to the maximum brightness of the largest accumulated data.

Generating second data may include reducing the maximum brightness of the selected pixel to which the current first data is to be supplied to the maximum brightness of the largest accumulated data.

Generating the second data may include determining a maximum bit value of the second data by dividing the maximum brightness of the largest accumulated data by the maximum brightness of the selected pixel and multiplying a result thereof to a maximum bit value of the current first data.

The method may include supplying the second data to pixels such that the pixels emit light or do not emit light in a plurality of sub frames included in a frame in response to the second data to display gray scales.

Current may flow from the first power source to a second power source via the OLED when the pixels emit light.

Controlling a voltage value of the first power source may include controlling the voltage value of the first power source so that an OLED included in the pixel having the largest accumulated data emits light having completely and/or substantially a same brightness as an initial brightness of the OLED.

Controlling a voltage value of the first power source may include increasing the voltage value of the first power source as the OLED deteriorates.

Storing the brightness characteristic may include supplying current to an OLED included in a dummy pixel when the first power source is supplied to the organic light emitting display, measuring an amount of light generated by the OLED included in the dummy pixel, and storing a brightness characteristic corresponding to emission time based on the measured amount of light.

The method may include measuring current temperature when the current first data is supplied, and changing a bit value of the current first data based on the measured current temperature.

At least one more of the above and other features and advantages of embodiments may be separately realized by providing a method of driving an organic light emitting display, including extracting maximum brightness of pixels, the maximum brightness of each pixel corresponding to a deterioration of an OLED included in each of the pixels, determining which one of the pixels has deteriorated the most relative to an initial brightness of the pixels, controlling a maximum brightness of remaining pixels to be completely and/or substantially equal to a maximum brightness of the pixel that has deteriorated the most, and controlling a voltage value of a first power source that supplies current to the OLED of each of the pixels so that the maximum brightness of the pixel that has deteriorated the most has a brightness that is completely and/or substantially completely a same as the initial brightness thereof.

Controlling the maximum brightness of the remaining pixels may include controlling a bit value of data corresponding to the remaining pixels.

At least one or more of the above and other features and advantages of embodiments may be separately realized by providing an organic light emitting display, including a scan driver adapted to sequentially supply scan signals during scan periods of a plurality of subfields included in one frame, a data driver adapted to supply at least one of first data signals in response to which pixels emit light and second data signals in response to which the pixels do not emit light when the scan signals are supplied, a deterioration compensator adapted to generate second data by controlling a bit value of respective current first data supplied to remaining ones of a plurality of pixels to have substantially and/or completely a same maximum brightness as the pixel of the plurality of pixels having a first maximum brightness, the first maximum brightness being a relatively lowest maximum brightness, and a timing controller adapted to receive the second data and supply third data for controlling emission time by subfields to the data driver.

The deterioration compensator may include a third memory adapted to store a brightness characteristic corresponding to emission time of an OLED, a first operator adapted to store accumulated data of the pixels generated by accumulating previously supplied first data associated with previous frames and the current first data in a first memory and to extract the first maximum brightness corresponding to a largest accumulated data among the accumulated data stored in the first memory and a second maximum brightness of accumulated data corresponding to the remaining pixels to which the current first data is to be supplied, a second operator adapted to generate the second data by changing the bit value of the current first data using the first maximum brightness and the second maximum brightness supplied from the first operator, and a second memory adapted to store the second data generated by the second operator.

The first operator may extract the first maximum brightness and the second maximum brightness using the accumulated data stored in an (i−1)th frame period when the current first data corresponding to an ith frame is supplied.

The second operator may generate the second data as follows: Second data=First data×(first maximum brightness/second maximum brightness).

The display may include a temperature sensor adapted to supply a current driving temperature to the first operator.

The first operator may be adapted to change a bit value of the current first data based on the current driving temperature.

The display may include a brightness characteristic measurer adapted to measure a brightness characteristic corresponding emission time of the OLED.

The brightness characteristic measurer may include a dummy pixel, the dummy pixel maintaining an emission state during a period where a power source is supplied to the organic light emitting display, a photo sensor adapted to measure an amount of light generated by the dummy pixel, an amplifier adapted to amplify an analog signal supplied from the photo sensor, and an analog digital converter adapted to change the amplified analog signal into a digital signal.

The first operator may store the digital signal corresponding to a driving time of the dummy pixel in the third memory.

The display may further include a power source controller adapted to control a voltage value of a power source supplied to a pixel associated with the largest accumulated data among the accumulated data stored in the first memory based on an initial brightness of an OLED included in the pixel.

BRIEF DESCRIPTION OF THE DRAWINGS

The above and other features and advantages of embodiments will become more apparent to those of ordinary skill in the art by describing in detail exemplary embodiments with reference to the attached drawings, in which.

DETAILED DESCRIPTION

Figure 1:
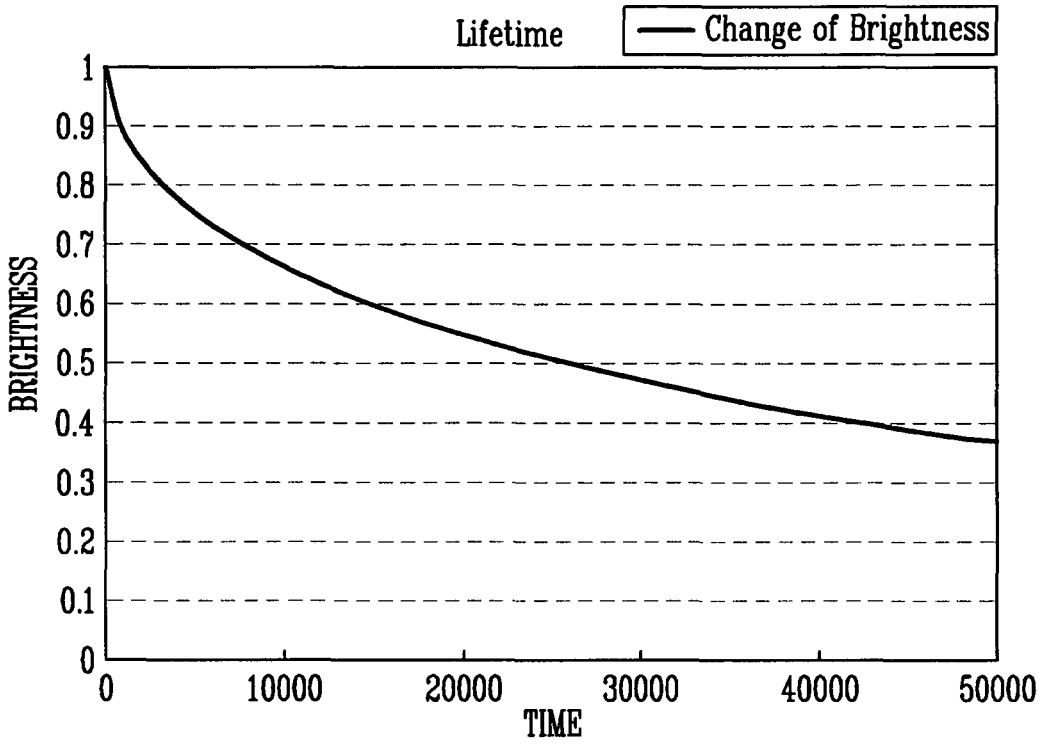
FIG. 1 illustrates a graph of a brightness characteristic relative to driving time of an organic light emitting diode (OLED) according to an embodiment.

Korean Patent Application No. 10-2007-0125545, filed on Dec. 5, 2007, in the Korean Intellectual Property Office, and entitled: "Organic Light Emitting Display and Method of Driving the Same," is incorporated by reference herein in its entirety.

Exemplary embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the embodiments to those skilled in the art.

As used herein, the terms "a" and "an" are open terms that may be used in conjunction with singular items or with plural items. As used herein, the expressions "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" includes the following meanings: A alone; B alone; C alone; both A and B together; both A and C together; both B and C together; and all three of A, B, and C together. As used herein, the expression "or" is not an "exclusive or" unless it is used in conjunction with the term "either."

Here, when a first element is described as being coupled to a second element, the first element may be not only be directly coupled to the second element but may also be indirectly coupled to the second element via a third element. Further, some of the elements that are not essential to the complete understanding of the invention are omitted for clarity. Hereinafter, exemplary embodiments will be described with reference to the accompanying drawings. Also, like reference numerals refer to like elements throughout the specification.

FIG. 1 illustrates a graph of a brightness characteristic corresponding to a driving time of an organic light emitting diode (OLED) according to an embodiment. In FIG. 1, the X axis represents time and the Y axis represents brightness. A value of "1" along the Y axis represents an initial brightness of an OLED.

As shown in FIG. 1, in general, OLEDs deteriorate over time. More particularly, e.g., a digitally driven OLED may deteriorate relatively rapidly with the lapse of time. That is, while an OLED may deteriorate due to temperature and/or as its chronological age increases, in general, deterioration of an OLED may be more heavily influenced by an amount of current that has passed through it. As a result of such deterioration, brightness of the OLED may be reduced. For example, an OLED that has emitted light for about five hours may emit light with a brightness of about 37% relative to an initial period of light emission thereof. When an OLED deteriorates, an image of desired brightness may not be displayed.

Figure 2:
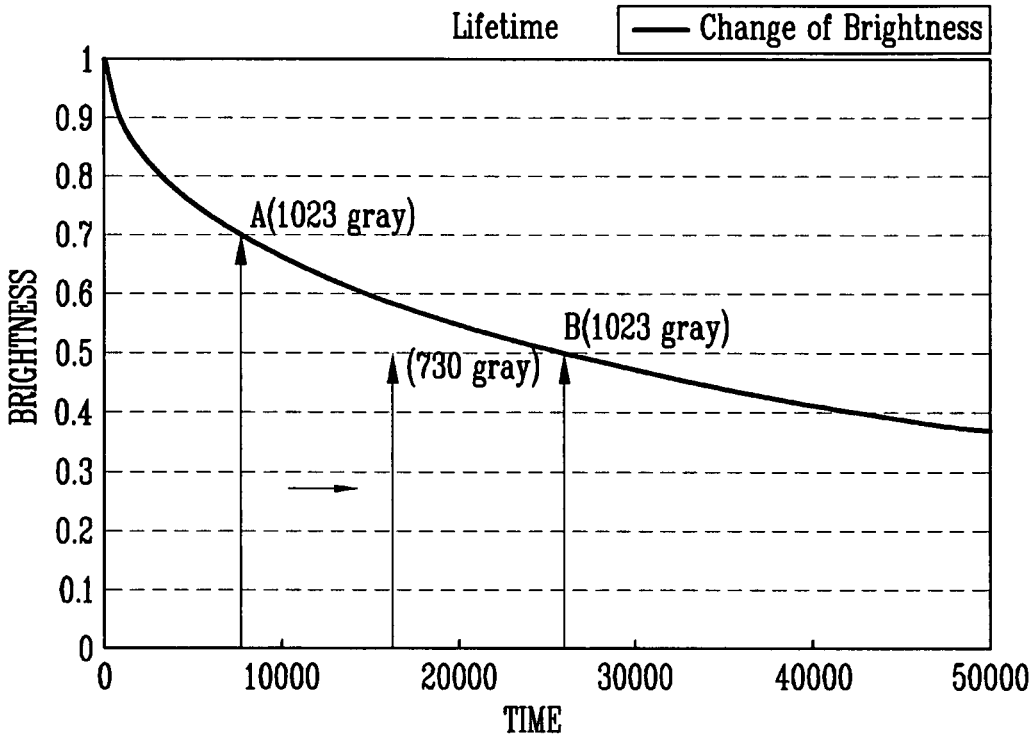
FIG. 2 illustrates a graph of a deterioration compensation method.

FIG. 2 illustrates a graph of a deterioration compensation principle employable by embodiments.

As shown in FIG. 2, brightness of pixels A, B may be reduced relative to emission time and/or chronological age, i.e., lapse in time, and/or temperature. Referring to FIG. 2, of the pixels A, B, it is shown that pixel B has deteriorated the most relative to an initial brightness during an initial period and pixel B now has a brightness of 0.5 of the initial brightness thereof. The pixel A has also deteriorated and now has a brightness of 0.7 of the initial brightness thereof.

Exemplary methods for compensating for deterioration of a pixel over time, e.g., emission time and/or chronological time, will be described below.

In embodiments, deterioration of an OLED of a pixel may be compensated for by increasing a brightness of the deteriorated pixel. To accommodate an increase in the brightness of the deteriorated pixel, a number of gray levels of the pixel may be reduced. That is, a number of gray levels that may be displayed by the pixel during an initial period may be reduced, i.e., the number of gray scales that may be displayed using data may be limited. More particularly, in embodiments, in order to compensate for deterioration of the pixel using data, an intermediate value of brightness that may express the gray levels of the initial white may be set and then, bits of data supplied to the deteriorated pixel may be increased to compensate for the deterioration.

When an initial white is set for a pixel, if all bits of data are set as "1," then it may not be possible to increase brightness of the pixel. However, if an initial white is set for the pixel with one or some of the bits of data being set as "0," then it may be possible to subsequently increase brightness of the pixel by subsequently changing, e.g., setting as "1," the one or more of the bits of data that were initially set as "0" for the initial white. That is, e.g., by subsequently setting more of the bits of data as "1" than a number of bits set as "1" for the initial white, it may be possible to increase brightness of the pixel and at least partially and/or completely compensate for deterioration of the pixel. In such embodiments, while an initial brightness may be relatively less, e.g., less than a maximum amount based on bits of data, brightness of the deteriorated pixel may be subsequently increased. More particularly, in embodiments, a relatively intermediate gray level of a plurality of possible gray levels for a predetermined number of bits of data may correspond to the initial white of the pixel. In such cases, gray levels brighter than the intermediate gray level corresponding to the initial white may be employed to partially and/or completely compensate for deterioration of the pixel. Further, possible gray levels darker than the intermediate gray level corresponding to the initial white may be employed to regularly drive the pixel. It should be understood that the intermediate gray level may be any gray level between a maximum and a minimum gray level.

An exemplary method of achieving uniform and/or substantially uniform brightness among a plurality of pixels by compensating for deterioration of one or more of the pixels will be described below. In embodiments including a plurality of pixels, e.g., a display device, to compensate for pixel deterioration, one of the pixels of the plurality of pixels may be selected and possible gray scale values for the plurality of pixels may be set based on an amount of deterioration of the selected pixel. The selected pixel may be, e.g., a most deteriorated pixel, a pixel believed and/or determined to be the most deteriorated based on, e.g., emission time, age, and/or temperature conditions, etc.

Referring to FIG. 2, of pixels A and B, pixel B has deteriorated more than pixel A and thus, pixel B is the most deteriorated pixel. In the example of FIG. 2, it is assumed that data for the pixels A, B includes up to 10 bits and may correspond to 1023 gray scales. As a result of the deterioration of the most deteriorated pixel B, a brightness of the remaining pixel A may be reduced to completely and/or substantially equal the brightness of the most deteriorated pixel B. That is, a maximum brightness of the remaining pixel A may be reduced to be completely and/or substantially the same as a maximum brightness of the most deteriorated pixel B. More particularly, a number and/or a state of the bits supplied to other pixel A corresponding to possible gray scale values may be controlled such that the remaining pixel A may display a fewer number of gray scales than the number of bits of the data allows. That is, e.g., in some embodiments, the other pixel A may simply be driven to display fewer gray scales. In some embodiments, e.g., this may be accomplished by one or more of the bits of data not playing a role in possible gray scale values, e.g., may be maintained at "0."

In the example of FIG. 2, one or more of the 10 of bits of data may be controlled such that pixel A may display, e.g., 730 gray scales rather than 1023 gray scales. More particularly, referring to FIG. 2, e.g., as pixel A may itself have deteriorated, deterioration of the other pixel A may also be considered when controlling the bits of data.

Specifically, in the example of FIG. 2, where pixel A may have 0.7 of its initial brightness, pixel B may have 0.5 of its initial brightness and the data may have 10 bits corresponding to 1023 possible gray scale values, uniformity may be provided by, e.g., reducing pixel A's gray scales to, e.g., (0.5/0.7)(1023)=730 gray scales. Thus, a maximum brightness of the pixel A may then be controlled based on 730 gray scale values to be equal to and/or substantially equal to a maximum brightness of the pixel B controlled based on 1023 gray scale values. In this case, the maximum brightness that may be displayed using data is set as the brightness of 0.5 of the initial brightness. However, while substantial and/or complete brightness uniformity of an image employing the pixels A, B may be achieved, a brightness of, e.g., a display including pixels A, B may be reduced.

Accordingly, in some embodiments, bits of data supplied to remaining pixels of a display, e.g., pixels other than a selected pixel, e.g., a most deteriorated pixel, may be controlled so that a substantially and/or completely same brightness as the brightness of the selected pixel may be displayed by reducing a maximum brightness of the remaining pixels to a maximum brightness of the selected pixel. While a display, e.g., an organic light emitting display, employing such a method may display images of completely and/or substantially uniform brightness, a brightness of the display may be reduced. Therefore, in embodiments, a voltage value of a first power source ELVDD may be controlled to uniformly maintain a brightness value of white.

Thus, in the example of FIG. 2, the maximum brightness of pixel A may be reduced to be completely and/or substantially the same as the maximum brightness of pixel B in order to provide an image of complete and/or substantially complete brightness uniformity. Further, to maintain an overall brightness of a display employing the pixels A, B a voltage value of a first power source ELVDD may be increased. By increasing the voltage value of the first power source ELVDD, a brightness that can be displayed by the pixels A, B may be set again to the initial brightness, i.e., as "1" in FIG. 2. That is, the first power source ELVDD may be controlled so that a white of the pixels A, B may be uniformly maintained regardless of the deterioration.

Figure 3:
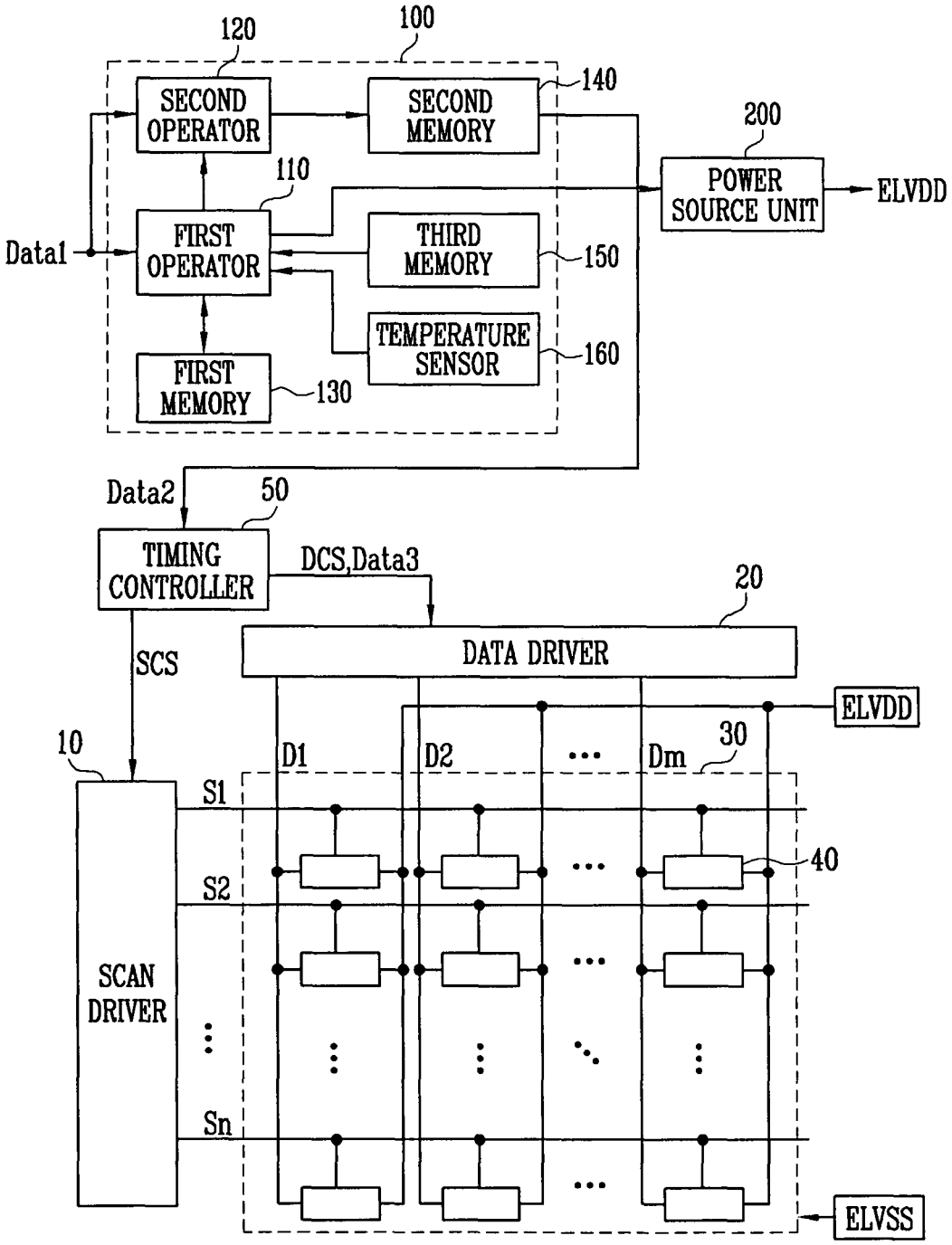
FIG. 3 illustrates a block diagram of an organic light emitting display according to an embodiment.

FIG. 3 illustrates an organic light emitting display according to an exemplary embodiment.

Referring to FIG. 3, an organic light emitting display according to an exemplary embodiment may include a pixel unit 30 including a plurality of pixels 40 coupled to scan lines S1 to Sn and data lines D1 to Dm, a scan driver 10 for driving the scan lines S1 to Sn, a data driver 20 for driving the data lines D1 to Dm, a timing controller 50 for controlling the scan driver 10 and the data driver 20, a deterioration compensating unit 100 and a power source unit 200. The deterioration compensating unit 100 may change a bit value of first data Data1, which may be externally supplied, so that deterioration of OLEDs included in the pixels 40 may be substantially and/or completely compensated for to generate second data Data2. The deterioration compensating unit 100 may supply the generated second data Data2 to the timing controller 50. The power source unit 200 may change the voltage value of the first power source ELVDD by controlling the deterioration compensating unit 100.

The pixel unit 30 may receive the voltage of the first power source ELVDD and a voltage of a second power source ELVSS and may supply the voltage of the first power source ELVDD and the voltage of the second power source ELVSS to the pixels 40. The pixels 40 may receive the first power source ELVDD and the second power source ELVSS. When scan signals are supplied, the pixels 40 may receive data signals and may or may not emit light based on the supplied data signals. The first power source ELVDD may be set to have a higher voltage value than the second power source ELVSS. An exemplary circuit diagram of a pixel 4 that may be employed as one or more of the pixels 40 will be described below in conjunction with FIG. 7.

Figure 4:
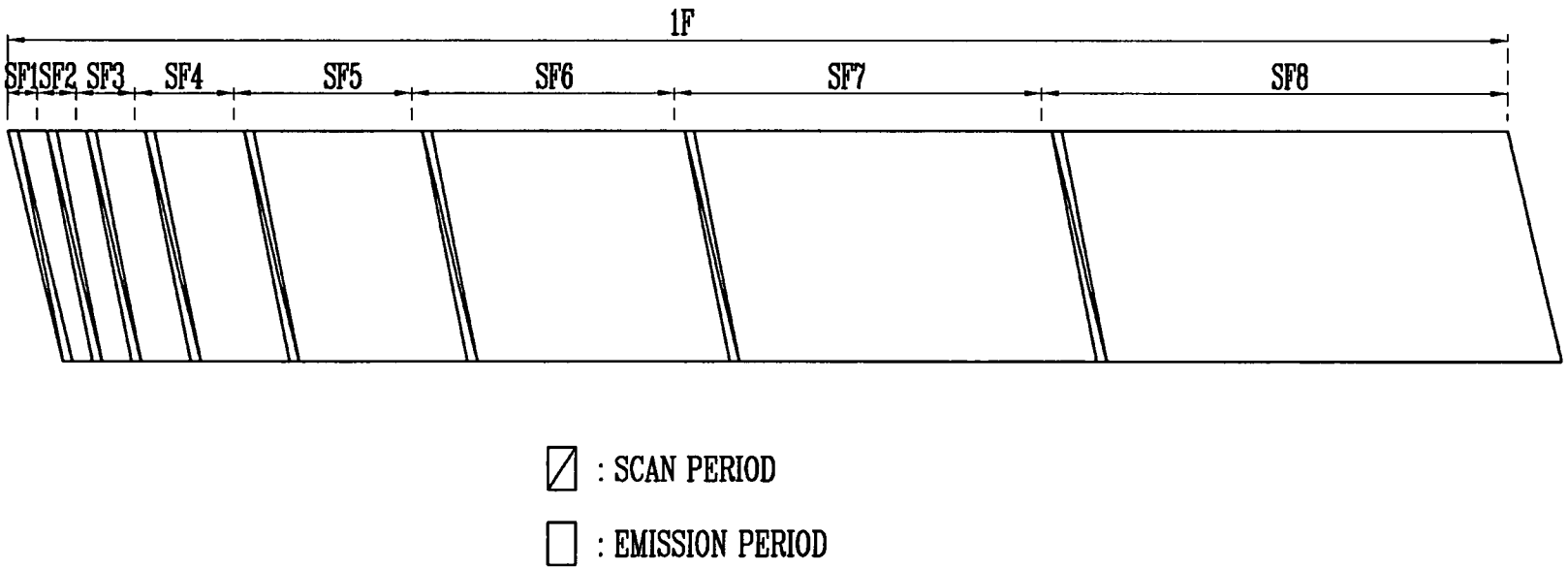
FIG. 4 illustrates a diagram of one frame according to an embodiment.

The scan driver 10 may sequentially supply the scan signals to the scan lines S1 to Sn. The scan driver 10 may sequentially supply the scan signals to the scan lines S1 to Sn during each scan period of a plurality of sub frames included in one frame 1F, as illustrated in FIG. 4. When the scan signals are sequentially supplied to the scan lines S1 to Sn, the pixels 40 may be sequentially selected and the selected pixels 40 may receive the respective data signals from the data lines D1 to Dm.

The data driver 20 may supply the respective data signals to the data lines D1 to Dm when the scan signals are supplied during the scan periods of the sub frames. The data signals may be supplied to the pixels 40 selected by the scan signals. In some embodiments, the data driver 20 may supply first data signals to the pixel(s) 40 that are to emit light and may supply second data signals to the pixel(s) that are not to emit light during a corresponding emission period. The pixels 40 that receive the first data signals may emit light during emission period(s) of corresponding sub frames for a predetermined period (a sub frame period) so that an image with predetermined brightness may be displayed.

The timing controller 50 may generate data driving control signals DCS and scan driving control signals SCS in response to externally supplied synchronizing signals. The data driving control signals DCS generated by the timing controller 50 may be supplied to the data driver 20 and the scan driving control signals SCS generated by the timing controller 50 may be supplied to the scan driver 10. The timing controller 50 may generate third data Data3 for controlling emission and non-emission by subfields using the second data Data2 supplied from the deterioration compensating unit 100. The timing controller 50 may supply the third data Data3 to the data driver 20.

The deterioration compensating unit 100 may change a bit value of the first data Data1 so that pixel deterioration may be substantially and/or completely compensated. The deterioration compensating unit 100 may generate the second data Data2 and may supply the generated second data Data2 to the timing controller 50.

The deterioration compensating unit 100 may include a first operator 110, a second operator 120, a first memory 130, a second memory 140, a third memory 150, and a temperature sensor 160.

The temperature sensor 160 may measure a current driving temperature and may supply a current driving temperature to the first operator 110.

The first operator 110 may receive the first data Data1 for determining emission time of the pixels 40 in units of frames. When the first operator 110 receives the first data Data1, the first operator 110 may add together accumulated data, which may be stored during a previous frame for the pixels 40, and the first data Data1 supplied during a current frame to generate new accumulated data. The first operator 110 may store the generated accumulated data in the first memory 130. The first operator 110 may add the first data Data1 supplied during each frame period for each of the pixels 40 to generate the accumulated data. For example, the accumulated data corresponding to a specific one of the pixels 40 during a seventh frame may be generated by adding accumulated data obtained by adding the first data Data1 corresponding to the specific pixel 40 during first, second, third, fourth, fifth and sixth frame periods to the first data corresponding to the specific pixel 40 during the seventh frame period.

The first operator 110 may change the bit value of the first data Data1 supplied during the current frame period in response to driving temperature. The current driving temperature may be supplied from the temperature sensor 160. The first operator 110 may add the changed first data Data1 to the accumulated data to generate new accumulated data. More specifically, a deterioration rate of an OLED may vary in accordance with temperature. Therefore, the bit value of the first data Data1 may be changed based on the current temperature when the first data Data1 is supplied. For example, the first operator 110 may add data of "0000000001" to the first data Data1 at specific temperature.

The first memory 130 may store accumulated data corresponding to the pixels 40. The total emission time of the pixels 40 may be obtained using the accumulated data corresponding to the pixels 40. More specifically, in digital driving, gray levels may be realized based on emission time. Because the emission time of each of the pixels 40 may be determined based on the first data Data1, it is possible to determine total emission time of each of the pixels 40 using the accumulated data of each of the pixels 40. In some embodiments, e.g., the first memory 130 may store the total emission time of each of the pixels 40. That is, e.g., in the case of a 1024×768 pixel display, the first memory may store at least 1024×768 values representing emission time for each of the pixels 40.

The third memory 150 may store a lookup table including values for a brightness characteristic and corresponding emission times. For example, corresponding values for the brightness characteristic and emission times of FIG. 2 may be stored in the third memory 150. Therefore, the first operator 110 may determine a degree of deterioration of the pixels 40 using the brightness characteristic stored in the third memory 150 and the accumulated data stored in the first memory 130. In exemplary embodiments, the first operator 110 may determine a degree of deterioration of each of the pixels based on the brightness characteristic that may be stored in the third memory 150 and the accumulated data that may be stored in the first memory 130.

The second operator 120 may change a bit value of the first data Data1 using information regarding brightness of, e.g., the pixel 40 that has deteriorated the most and a maximum brightness of one, some or each of the pixels 40. The second operator 120 may determine the pixel 40 that has deteriorated the most from the first operator 110. The second operator 120 may generate the second data Data2 and may store the generated second data Data2 in the second memory 140.

More specifically, the first operator 110 may extract the largest accumulated data, i.e., the accumulated data corresponding to the largest amount of emitted light, among the accumulated data stored in the first memory 130. For example, the first operator 110 may calculate the maximum brightness of the most deteriorated pixel, i.e., the darkest pixel, using the brightness characteristic stored in the third memory 150. The first operator 110 may supply the maximum brightness to the second operator 120. That is, e.g., in embodiments, the first operator 110 may extract the accumulated data of the currently input first data Data1, may calculate the maximum brightness of the extracted accumulated data and may supply the maximum brightness to the second operator 120.

The second operator 120 may receive the maximum brightness of the darkest pixel 40 and the maximum brightness of the pixel 40 to which the currently input first data Data1 is to be supplied and may change the first data Data1 using Equation 1 to generate the respective second data Data2.

$$\text{Data2}=\text{Data1}\times(\max B \text{ of darkest pixel}/\max B \text{ of current pixel})$$

In Equation 1, B corresponds to brightness, the current pixel corresponds to the pixel of the pixels 40 to which the respective first data Data1 is to be supplied. For example, when the maximum brightness of the darkest pixel 40 is 0.5 and the maximum brightness of the current pixel 40 is 1, using Equation 1, a bit value of the first data Data1 for the current pixel 40 may reduced by 0.5. That is, the second operator 120 may control a bit value of the respective first data Data1 so that the brightness of a less deteriorated pixel 40 may be completely and/or substantially equal to the maximum brightness of the most deteriorated pixel 40 and may thereby generate the second data Data2. The second data Data2 for each of the pixels 40 may be stored in the second memory 140.

In some embodiments, the calculation of Equation 1 for determining the respective Data2 may be performed for each of the pixels 40. In some embodiments, the calculation of Equation 1 for determining the respective Data2 may be performed for only two or some of the pixels. For example, in some embodiments, a determination regarding the most deteriorated and least deteriorated pixel of the pixels 40 may be made, and based on calculations for the most deteriorated pixel and the least deteriorated pixel of the pixels 40, a predetermined value resulting from such calculations may be employed for a remainder of the pixels 40.

The power source unit 200 may receive information on the brightness of the most deteriorated pixel 40 from the first operator 110. The power source unit 200 may use the information on the brightness of the most deteriorated pixel 40 to control a voltage value of the first power source ELVDD so that the brightness of the most deteriorated pixel 40 is completely and/or substantially equal to the initial brightness thereof (brightness before the respective OLED deteriorated). Then, the power source unit 200 may supply the first power source ELVDD whose voltage value may be controlled to the pixels 40.

The power source unit 200 may control the voltage value of the first power source ELVDD so that the brightness of the most deteriorated pixel 40, i.e., the darkest pixel, may be completely and/or substantially equal to the initial brightness thereof.

The second operator 120 may change the bit value of the first data Data1 and may generate the second data Data2 using Equation 1. Accordingly, the maximum brightness of all of the pixels may be substantially and/or completely equal to the maximum brightness of the most deteriorated pixel 40. The second operator 120 may store the generated second data Data2 in the second memory 140.

The second data Data2 stored in the second memory 140 may be supplied to the timing controller 50. Then, the timing controller 50 may calculate the emission time of the respective subfields using the second data Data2 supplied thereto. The timing controller 50 may supply the third data Data3 corresponding to emission and non-emission to the data driver 20 in units of subfields.

The data driver 20 may supply the first data signals and the second data signals in units of subfields to control the emission and non-emission of the pixels 40. As described above, in embodiments, because the maximum brightness of the pixels 40 may be set to be substantially and/or completely equal to the maximum brightness of the most deteriorated pixel 40, i.e., the darkest pixel, it may be possible to display an image with substantially and/or completely uniform brightness. In addition, in embodiments, because the first power source ELVDD may be controlled so that the brightness of the most deteriorated pixel 40, i.e., the darkest pixel, may be as bright as the initial brightness thereof, it may be possible to display an image of desired brightness. In embodiments, by setting a maximum brightness of the remaining pixels 40 to be substantially and/or completely equal to a maximum brightness of the most deteriorated pixel, e.g., the darkest pixel, and by controlling the first power source ELVDD, it may be possible to display an image of substantially and/or completely uniform desired brightness.

More particularly, e.g., in some embodiments the first power source ELVDD may be controlled based on an amount of deterioration of the most deteriorated pixel, e.g., the darkest pixel. For example, in some embodiments, a value of the first power source ELVDD may be changed, e.g., increased, to compensate, e.g., substantially compensate and/or completely compensate, for a reduced brightness of the display as a result of the deterioration of the most deteriorated pixel, and the value of the first power source ELVDD resulting therefrom may be employed for all the pixels of the display.

Figure 5:
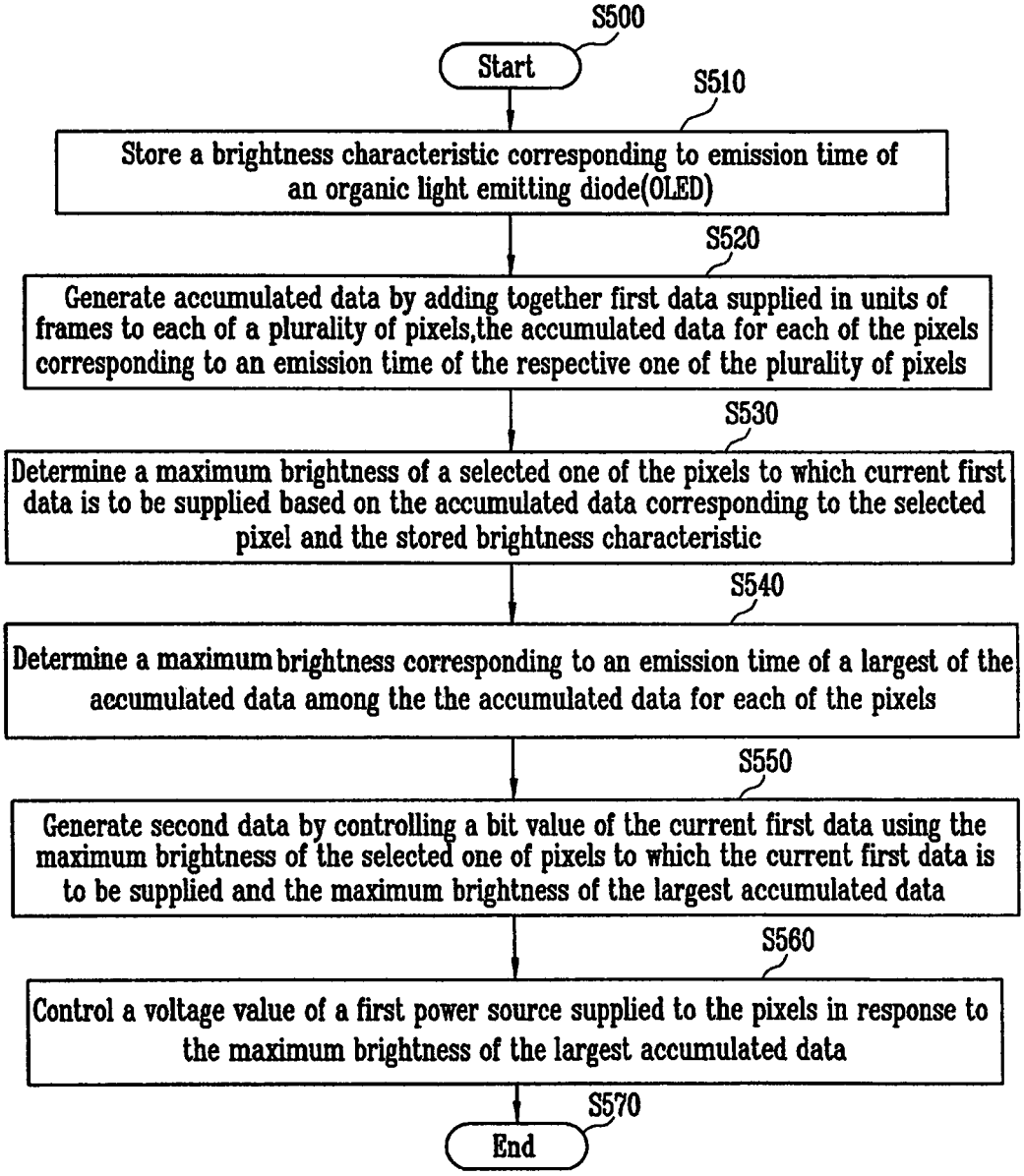
FIG. 5 illustrates a flow chart of an exemplary method of compensating for OLED deterioration according to an exemplary embodiment.

FIG. 5 illustrates a flow chart of an exemplary method of substantially and/or completely compensating for OLED deterioration according to an exemplary embodiment.

Referring to FIG. 5, an exemplary method may begin S500 and may include storing a brightness characteristic corresponding to an emission time of an OLED S510. While a sequence of events is described below, those skilled in the art would appreciate that embodiments are not limited to the exact sequence set forth below.

As described above, the brightness characteristic may be stored in the third memory 150. Further, the brightness characteristic may be, e.g., values corresponding to a look up table, values obtained by real-time measurement, etc. During S520, accumulated data may be generated by adding together current first data a previous current data associated with previous frame(s). As discussed above, in embodiments, first data supplied to each of the pixels during previous frames of may be stored in the first memory 130. The first operator 110 may access the first memory 130 and add the current first data to the previously stored first data corresponding to the previous frame(s) to generate new accumulated data. More particularly, e.g., once a current first data is determined according to the method, the new accumulated may be stored in the first memory 130. Further, as discussed above, e.g., during an ith frame period, where i is a natural number, the first operator 110 may supply the brightness of the largest accumulated data corresponding to the most deteriorated pixel OLED among the accumulated data stored in the first memory 130 during an (i−1)th frame period to the second operator 120 and/or the power source unit 200.

During S530, a maximum brightness of a pixel to which current first data is to be supplied may be determined. More particularly, e.g., the maximum brightness of a pixel to which the current first data is to be supplied may be determined by the first operator 110 based on the accumulated data stored in the first memory 130 and the brightness characteristic stored in the third memory 150. The first operator 110 may supply to the second operator 120 a brightness of the accumulated data (stored in the (i−1th) frame) corresponding to the selected pixel to which the current first data is to be supplied.

During S540, a maximum brightness of a most deteriorated pixel, e.g., pixel with largest accumulated data of all the pixels, may be determined by the second operator 120 based on the accumulated data stored in the first memory 130 and the brightness characteristic stored in the third memory 150.

During S550, respective second data may be generated by the second operator 120. As discussed above, the respective second data may be generated by controlling a bit value of the current first data based on the maximum brightness of the most deteriorated pixel and the maximum brightness of the pixel to which the current first data is to be supplied.

Some embodiments may include S560, during which a voltage value of the first power source ELVDD may be adjusted. As discussed above, e.g., a voltage value of the first power source ELVDD may be increased to help maintain an overall brightness of the display. More particularly, e.g., the voltage value of the first power source ELVDD may be increased relative to the deterioration of the OLED of the most deteriorated pixel. The method may end S570.

It should be understood that while a single pixel may be described as a most deteriorated pixel, embodiments are not limited thereto. For example, in some embodiments, characteristics of a plurality of the pixels suffering from relatively higher levels of OLED deterioration may be considered.

Figure 6:
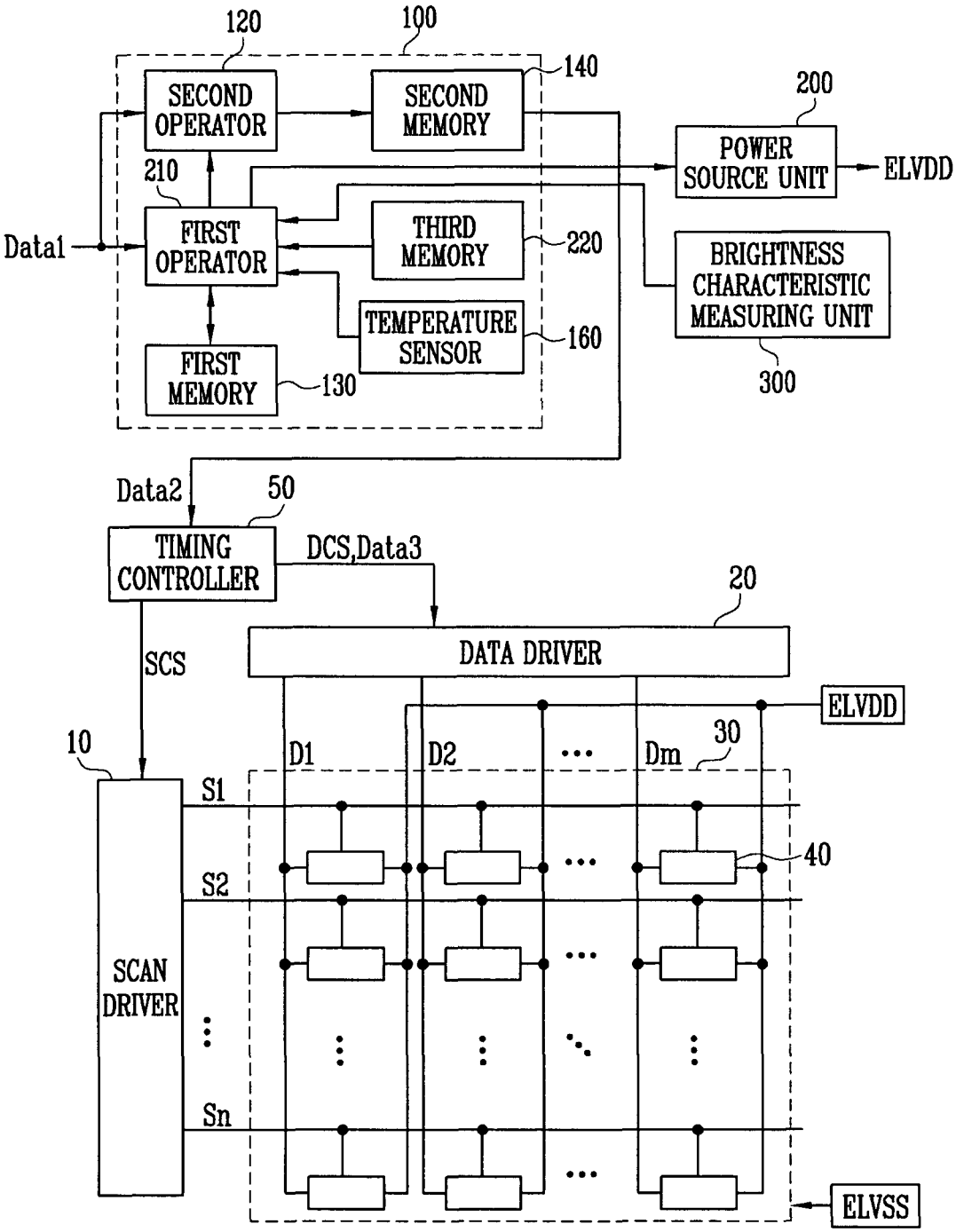
FIG. 6 illustrates a schematic diagram an organic light emitting display according to another embodiment.
Figure 7:
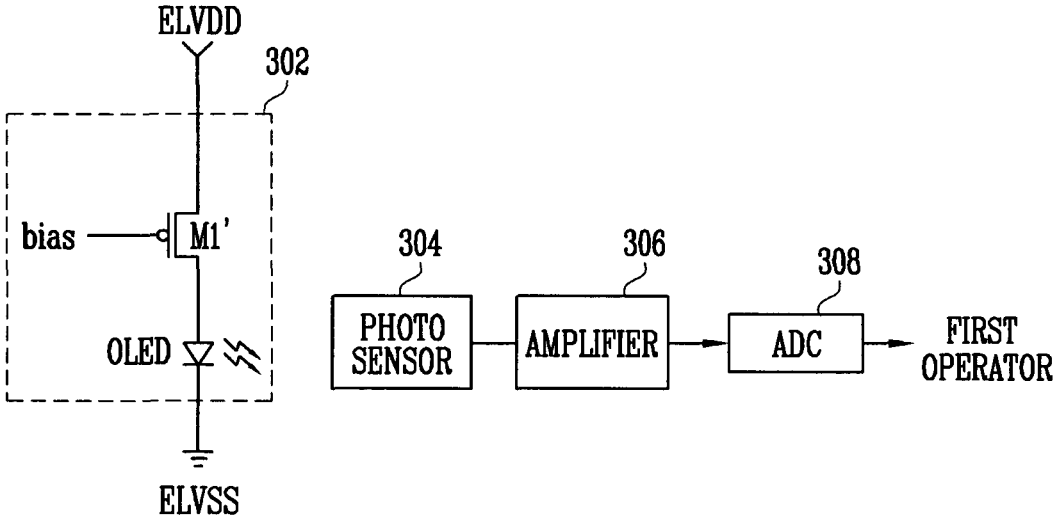
FIG. 7 illustrates a schematic diagram of the brightness characteristic measuring unit of FIG. 5.

FIG. 6 illustrates an organic light emitting display according to another exemplary embodiment. FIG. 7 illustrates a schematic diagram of a brightness characteristic measuring unit 300 of the display of FIG. 6. In general, only differences between the exemplary embodiment of FIG. 3 and the exemplary embodiment of FIG. 6 will be described below.

Referring to FIG. 6, in embodiments, the organic light emitting display may include the brightness characteristic measuring unit 300, a first operator 210 and a third memory 220. The brightness characteristic measuring unit 300 may supply a brightness characteristic corresponding to an emission time to the first operator 210. More particularly, the brightness characteristic measuring unit 300 may supply a brightness characteristic corresponding to an emission time of a corresponding one of the pixels 40 to the first operator 210. The first operator 210 may store the brightness characteristic corresponding to the emission time in a third memory 220.

In the exemplary embodiment of FIG. 3, values of the brightness characteristic corresponding to emission time may be predetermined values that are previously stored in the third memory 150. In such embodiments, the correctness of the brightness characteristic corresponding to emission time may be reduced due to material characteristic and/or process deviation of the respective OLED. In the exemplary embodiment of FIG. 6, while values of the brightness characteristic corresponding to emission time may be stored in the third memory 220, the values may be obtained by the brightness characteristic measuring unit as a result of a current measurement, e.g., measurement in real time. That is, in embodiments, the brightness characteristic of the OLED may be measured in real time using the brightness characteristic measuring unit 300.

Referring to FIG. 7, the brightness characteristic measuring unit 300 may include a dummy pixel 302, a photo sensor 304, an amplifier 306, and an analog-digital converter (ADC) 308.

The dummy pixel 302 may be provided in a region excluding the pixel unit 30. The dummy pixel 302 may include a first transistor M1' between the first power source ELVDD and the second power source ELVSS and an OLED. The first transistor M1' may receive a bias voltage to control an amount of current that may be supplied from the first power source ELVDD to the OLED. Current supplied from the first transistor M' may be set to be equal to current that flows when the pixel 40 emits light.

As described above, the dummy pixel 302 may always be driven when a power source is supplied to the organic light emitting display. That is, a bias voltage bias may be supplied when the power source is supplied to the organic light emitting display, so the OLED may always generate light while the power source is supplied. Therefore, the OLED included in the dummy pixel 302 may deteriorate faster than the pixels 40 included in the pixel unit 30.

The photo sensor 304 may sense an amount of light generated by the OLED. The photo sensor 304 may generate an analog signal corresponding to the amount of light.

The amplifier 306 may amplify an analog signal supplied from the photo sensor 304 and may supply the analog signal to the ADC 308. The ADC 308 may convert the analog signal into a digital signal and may supply the digital signal to the first operator 210. Then, the first operator 210 may store the digital signal corresponding to driving time, i.e., time for which the power source is supplied, in the third memory 220. That is, information, e.g., values corresponding to information like that of FIG. 2, on the brightness corresponding to time may be stored in the third memory 220.

As described above, the brightness characteristic measuring unit 300 may measure information on the deterioration of the OLED in real time and may supply the information to the first operator 210. In such embodiments, the brightness characteristic corresponding to the process deviation of the OLED may be correctly stored in the third memory 220.

Figure 8:
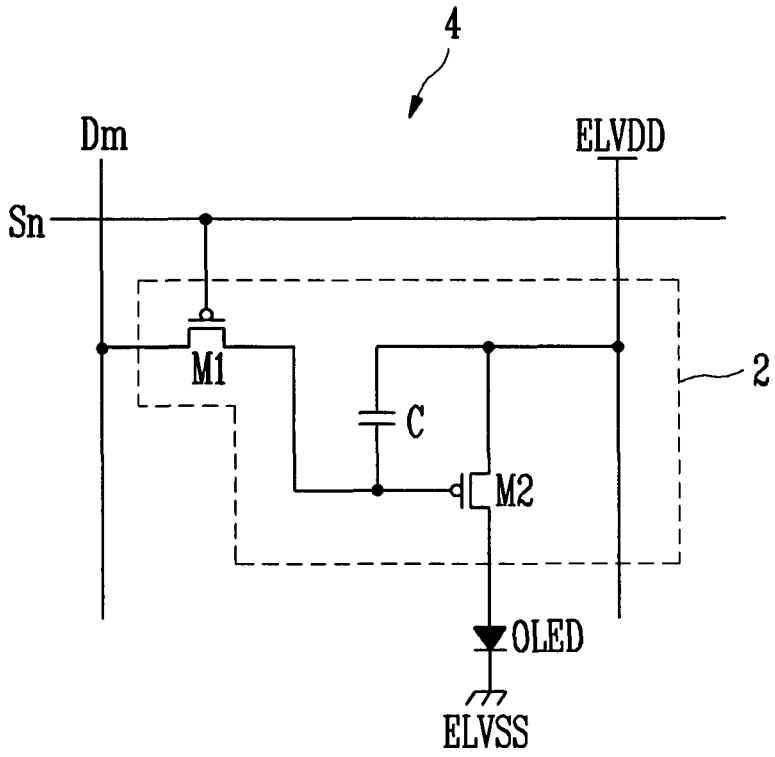
FIG. 8 illustrates a circuit diagram of an exemplary pixel employable by the organic light emitting displays of FIGS. 3 and 5.

FIG. 8 illustrates a circuit diagram of the exemplary pixel 4 by an organic light emitting display, e.g., as the pixels 40 in the organic light emitting displays of FIGS. 3 and 6.

Referring to FIG. 1, the pixel 4 may include an organic light emitting diode OLED and a pixel circuit 2 electrically coupled to a data line Dm and a scan line Sn. The pixel circuit 2 may control the OLED. An anode electrode of the OLED may be coupled to the pixel circuit 2 and a cathode electrode of the OLED may be coupled to a second power source ELVSS. The OLED may generate light with predetermined brightness corresponding to current supplied from the pixel circuit 2.

The pixel circuit 2 may control an amount of current supplied to the OLED based on a data signal supplied to the data line Dm when a scan signal is supplied to the scan line Sn. The pixel circuit 2 may include a first transistor M1 coupled to the data line Dm and the scan line Sn, a second transistor M2 coupled to the first transistor M1, the first power source ELVDD and the OLED and a storage capacitor C coupled between a gate electrode and a first electrode of the second transistor M2.

A gate electrode of the first transistor M1 may be coupled to the scan line Sn and a first electrode may be coupled to the data line Dm. A second electrode of the first transistor M1 may be coupled to a first terminal of the storage capacitor C. The first electrode of the first transistor M1 may be set as one of a source electrode and a drain electrode and the second electrode of the first transistor M1 may be set as the other of the source electrode and the drain electrode. The first transistor M1 coupled to the scan line Sn and the data line Dm may be turned on when a scan signal is supplied from the scan line Sn to supply a data signal supplied from the data line Dm to the storage capacitor C. At this time, the storage capacitor C may charge a voltage corresponding to the data signal.

The gate electrode of the second transistor M2 may be coupled to one terminal of the storage capacitor C and the first electrode may be coupled to the other terminal of the storage capacitor C and the first power source ELVDD. A second electrode of the second transistor M2 may be coupled to the anode electrode of the OLED. The second transistor M2 may control an amount of current supplied from the first power source ELVDD to the second power source ELVSS via the OLED to correspond to a voltage value stored in the storage capacitor C. At this time, the OLED may generate light corresponding to the amount of current supplied from the second transistor M2.

The pixel 4 may display an image with predetermined brightness while repeating the above-described processes. Further, in digital driving where the second transistor M2 may be operated by a switch, the first power source ELVDD and the second power source ELVSS may be directly supplied to the OLED and the OLED may emit light by constant voltage driving.

Embodiments may reduce a maximum brightness of remaining pixels, e.g., pixels other than a most deteriorated pixel, to a maximum brightness of the most deteriorated pixel, such that it may be possible to display an image with completely and/or substantially uniform brightness.

Embodiments may control a voltage of a first power source so that the most deteriorated pixel may emit light with initial brightness, such that it may be possible to display an image with desired brightness.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the exemplary embodiments as set forth in the following claims.

What is claimed is:

1. A method of driving an organic light emitting display, comprising:

storing a brightness characteristic corresponding to emission time of an organic light emitting diode (OLED);

generating accumulated data by adding together first data supplied in units of frames to each of a plurality of pixels, the accumulated data for each of the pixels corresponding to an emission time of the respective one of the plurality of pixels;

determining a maximum brightness of a selected one of the pixels to which current first data is to be supplied based on the accumulated data corresponding to the selected pixel and the stored brightness characteristic;

determining a maximum brightness corresponding to an emission time of a largest of the accumulated data among the accumulated data for each of the pixels;

generating second data by controlling a bit value of the current first data using the maximum brightness of the selected pixel to which the current first data is to be supplied and the maximum brightness of the largest accumulated data, wherein controlling the bit value includes supplying fewer gray scales to least deteriorated pixels; and controlling a voltage value of a first power source supplied to the plurality of pixels, controlling including increasing the voltage value of the first power source in response to the maximum brightness of the largest accumulated data such that the pixel having the largest accumulated data has a brightness of up to an initial brightness thereof.

2. The method as claimed in claim 1, wherein generating second data includes reducing the maximum brightness of the selected pixel to which the current first data is to be supplied to the maximum brightness of the largest accumulated data.

3. The method as claimed in claim 2, wherein generating the second data includes determining a maximum bit value of the second data by dividing the maximum brightness of the largest accumulated data by the maximum brightness of the selected pixel and multiplying a result thereof to a maximum bit value of the current first data.

4. The method as claimed in claim 1, further comprising supplying the second data to pixels such that the pixels emit light or do not emit light in a plurality of sub frames included in a frame in response to the second data to display gray scales.

5. The method as claimed in claim 4, wherein current flows from the first power source to a second power source via the OLED when the pixels emit light.

6. The method as claimed in claim 5, wherein controlling a voltage value of the first power source includes controlling the voltage value of the first power source so that an OLED included in the pixel having the largest accumulated data emits light having completely and/or substantially a same brightness as an initial brightness of the OLED.

7. The method as claimed in claim 1, wherein increasing the voltage value of the first power source occurs as the OLED deteriorates.

8. The method as claimed in claim 1, wherein storing the brightness characteristic comprises:

supplying current to an OLED included in a dummy pixel when the first power source is supplied to the organic light emitting display;

measuring an amount of light generated by the OLED included in the dummy pixel; and storing a brightness characteristic corresponding to emission time based on the measured amount of light.

9. The method as claimed in claim 1, further comprising:

measuring current temperature when the current first data is supplied; and changing a bit value of the current first data based on the measured current temperature.

10. A method of driving an organic light emitting display, comprising:

extracting maximum brightness of pixels, the maximum brightness of each pixel corresponding to a deterioration of an OLED included in each of the pixels;

determining which one of the pixels has deteriorated the most relative to an initial brightness of the pixels;

controlling a maximum brightness of remaining pixels to be completely and/or substantially equal to a maximum brightness of the pixel that has deteriorated the most by controlling a bit value of data corresponding to the remaining pixels, including supplying fewer gray scales to least deteriorated pixels; and controlling a voltage value of a first power source that supplies current to the OLED of each of the pixels so that the maximum brightness of the pixel that has deteriorated the most has a brightness that is completely and/or substantially completely a same as the initial brightness thereof, controlling including increasing the voltage value of the first power source in accordance with the maximum brightness of the largest accumulated data such that the pixel that has deteriorated the most has a brightness of up to an initial brightness thereof.

11. An organic light emitting display, comprising:

a scan driver adapted to sequentially supply scan signals during scan periods of a plurality of subfields included in one frame;

a data driver adapted to supply at least one of first data signals in response to which pixels emit light and second data signals in response to which the pixels do not emit light when the scan signals are supplied;

a deterioration compensator adapted to generate second data by controlling a bit value of respective current first data supplied to remaining ones of a plurality of pixels to have substantially and/or completely a same maximum brightness as the pixel of the plurality of pixels having a first maximum brightness, the first maximum brightness being a relatively lowest maximum brightness, wherein controlling the bit value includes supplying fewer gray scales to least deteriorated pixels;

a timing controller adapted to receive the second data and supply third data for controlling emission time by subfields to the data driver; and a power source controller adapted to control a voltage value of a power source supplied to the plurality of pixels, control including increasing the voltage value of the power source in accordance with the first maximum brightness such that a pixel having the first maximum brightness has a brightness of up an initial brightness of the pixel.

12. The organic light emitting display as claimed in claim 11, wherein the deterioration compensator comprises:

a third memory adapted to store a brightness characteristic corresponding to emission time of an OLED;

a first operator adapted to store the accumulated data of the pixels generated by accumulating previously supplied first data associated with previous frames and the current first data in the first memory and to extract the first maximum brightness corresponding to a largest accumulated data among the accumulated data stored in the first memory and a second maximum brightness of accumulated data corresponding to the remaining pixels to which the current first data is to be supplied;

a second operator adapted to generate the second data by changing the bit value of the current first data using the first maximum brightness and the second maximum brightness supplied from the first operator; and a second memory adapted to store the second data generated by the second operator.

13. The organic light emitting display as claimed in claim 12, wherein the first operator extracts the first maximum brightness and the second maximum brightness using the accumulated data stored in an (i−1)th frame period when the current first data corresponding to an ith frame is supplied.

14. The organic light emitting display as claimed in claim 12, wherein the second operator generates the second data as follows:

$$\text{Second data} = \text{First data} \times (\text{first maximum brightness} / \text{second maximum brightness}).$$

15. The organic light emitting display as claimed in claim 12, further comprising a temperature sensor adapted to supply a current driving temperature to the first operator.

16. The organic light emitting display as claimed in claim 15, wherein the first operator is adapted to change a bit value of the current first data based on the current driving temperature.

17. The organic light emitting display as claimed in claim 12, further comprising a brightness characteristic measurer adapted to measure a brightness characteristic corresponding emission time of the OLED.

18. The organic light emitting display as claimed in claim 17, wherein the brightness characteristic measurer comprises:

a dummy pixel, the dummy pixel maintaining an emission state during a period where a power source is supplied to the organic light emitting display;

a photo sensor adapted to measure an amount of light generated by the dummy pixel;

an amplifier adapted to amplify an analog signal supplied from the photo sensor; and an analog digital converter adapted to change the amplified analog signal into a digital signal.

19. The organic light emitting display as claimed in claim 18, wherein the first operator stores the digital signal corresponding to a driving time of the dummy pixel in the third memory.

* * * * *